US005809623A

United States Patent [19]

Dykstra

[11] Patent Number: 5,809,623

[45] Date of Patent: Sep. 22, 1998

[54] SQUEEZE CLAMP

[75] Inventor: Henry Dykstra, Hartland, Mich.

[73] Assignee: Delaware Capital Formation, Inc., Wilmington, Del.

[21] Appl. No.: 907,261

[22] Filed: Aug. 6, 1997

[51] Int. Cl.[6] ..... A44B 21/00

[52] U.S. Cl. ..... 24/514; 24/483; 24/535

[58] Field of Search ..... 24/514, 525, 535, 24/483, 346, 370, 279; 269/221

[56] References Cited

U.S. PATENT DOCUMENTS

| | | | |
|---|---|---|---|
| 2,560,613 | 7/1951 | Wahl | 24/535 |
| 2,815,555 | 12/1957 | Robbins | 24/514 |
| 3,494,005 | 2/1970 | Baker et al. | 24/514 |
| 3,736,629 | 6/1973 | Blake | 24/514 |
| 4,619,447 | 10/1986 | Blake | 24/514 |
| 5,157,816 | 10/1992 | Huessler | 24/483 |

FOREIGN PATENT DOCUMENTS

| | | | |
|---|---|---|---|
| 0253884 | 2/1927 | United Kingdom | 24/535 |

*Primary Examiner*—Victor N. Sakran
*Attorney, Agent, or Firm*—Dinnin & Dunn, P.C.

[57] ABSTRACT

An improved squeeze clamp including a plurality of link members. The link members including a plurality of orifices. The link members are connected via a common pivot point. A threaded member connected between at least two link members. The clamp capable of being driven by an electrical driving mechanism such as an electrical screw driver.

18 Claims, 4 Drawing Sheets

SQUEEZE CLAMP

BACKGROUND OF THE INVENTION

1. Field of the Invention

The present invention relates to clamps, and more particularly to an improved squeeze clamp driven by an electrical driver unit.

2. Description of Related Art

Squeeze clamps have been known in the art for many years. Squeeze clamps are used to clamp together two objects or to hold a cover to a surface. Many of the prior art squeeze clamps have handles which control the amount of force being applied at the squeezing jaws. Many of the handle squeeze clamps also have a locking bar which allows the clamp to be locked about the surface being clamped. The locking bar may be released to allow the jaws to unclamp thus releasing the cover member being held to the surface. However, these prior arts squeeze clamps are not user friendly. The angles at which the clamps must be used and the force required to close the clamps cause carpaltunnel syndrome and other associated diseases of the hand, arm, elbow, shoulder and neck. Hence, the prior art clamps create down time in the workforce and thus lower productivity and increase production cost. Problems also occur with the prior art squeeze clamps in that the handles interfere with the alignment of the clamp, the worker or user occupied area and the objects being clamped.

Therefore, there is a need in the art for a squeeze clamp that is ergonomically designed and user friendly so that physical ailments such as carpaltunnel syndrome and other wrist related ailments do not occur. There is also a need in the art for a squeeze clamp that does not have handles so the clamps can be used in more confined spaces and placed where necessary with minimal interference to the work area.

SUMMARY OF THE INVENTION

One object of the present invention is to provide an improved squeeze clamp.

Another object of the present invention is to provide a user friendly squeeze clamp.

A further object of the present invention is to provide a squeeze clamp which can be operated by a standard drill drive device or by manual operation.

Yet a further object of the present invention is to provide a variable clamping strength squeeze clamp that does not have handles.

To achieve the foregoing objects, the improved squeeze clamp includes a plurality of link members connected at a single pivot point. The squeeze clamp further includes an adjustable turn buckle member used for opening and closing the clamp. The clamp being operable by an electrical screw driver or other driving mechanism or by manual means such as a screw driver.

One advantage of the present invention is that it affords better opening and closing speed for the squeeze clamp.

A further advantage of the present invention is that it is user friendly and ergonomically designed.

A further advantage of the present invention is that the clamp is adjustable to provide different angles for use.

Yet a further advantage of the present invention is that all of the stampings use the same blanks thus reducing the cost to manufacture the clamp.

Yet a further advantage of the present invention is that the clamp has a variable clamp strength depending on the needs and use of the user.

Other objects, features and advantages of the present invention will become apparent from the subsequent description and appended claims, taken in conjunction with the accompanying drawings.

Figure 1:
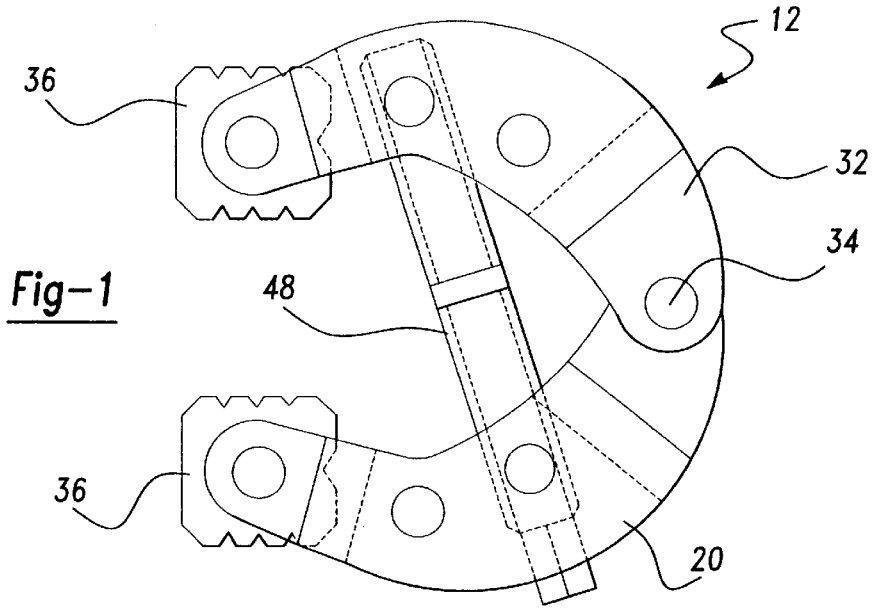
FIG. 1 shows a plan view of the present invention.
Figure 2:
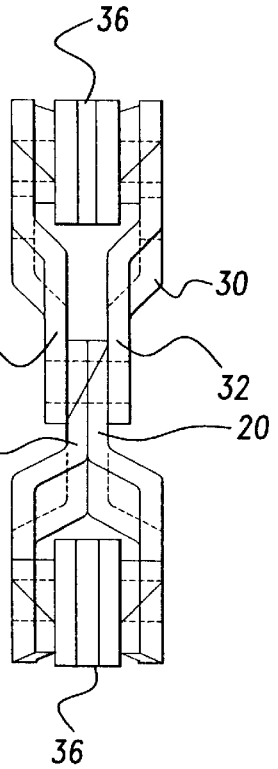
FIG. 2 shows a top view of the present invention.

BEST MODE OF CARRYING OUT THE INVENTION AND DESCRIPTION OF THE PREFERRED EMBODIMENT(S)

Referring to the drawings, an improved squeeze clamp 12 is shown. The squeeze clamp 12 is used for holding one object 16, two objects together or holding an object to a fixed surface. The squeeze clamp 12 is capable of being driven by an electrical screwdriver 14 or by any other electrical or automatic driving means, however, it should also be noted that the squeeze clamp 12 may be driven by manual means such as a screw driver or allen wrench or any other manual method of closing the clamp. The squeeze clamp 12 is ergonomically friendly and is adjustable in order to create more user friendly angles for the users wrist and arm during installation of the clamps. Thus, any standard driver that can be used in any electrical screw driver or manual screw driver may be used to open and close the squeeze clamp 12.

Figure 5:
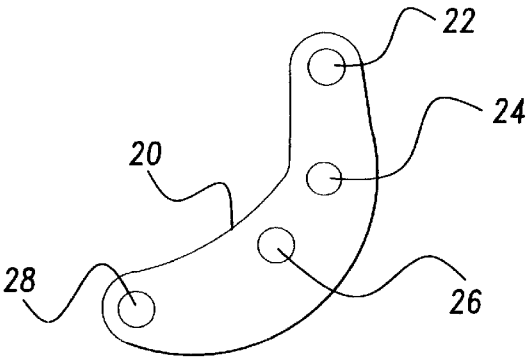
FIG. 5 shows a side view of a link member.

The squeeze clamp 12 includes a link member 20. The link member 20 in the preferred embodiment includes four circular orifices (22, 24, 26, 28) However, it should be noted that any other shape orifice may be used and that any number of orifices in different positions may also be used depending on the needs of the user. The link member 20 generally has a J-shape as shown in FIG. 5. The link member 20 also includes a first off-set 30 on one end thereof. The first off-set 30 is an outward projecting step. On the opposite end of the link member is an additional off-set which is an outward step from the opposite end of the link member 20. The squeeze clamp 12 includes a total of four separate link members each formed from the same stamping blank. This reduces the cost of manufacturing and assembly because of the same blank being used for all four link members of the squeeze clamp 12. Two of those link members 20 are identical as described above. The other two link members 32 also include two off-sets one occurring at each end but the off-sets are designed such that the second pair of identical link members 32 will surround the first pair of link members 20 when connected at a common pivot point 34.

The first link member 20 and the second link member 20 which are identical to one another are surrounded by a third link member 32 and fourth link member 32 which are also identical to one another and then connected via orifice 28 by a rivet member or any other acceptable fastener. This pivot point 34 allows the third and fourth link members 32 to rotate about the first and second link members 20. It should be noted that link members are preferably made of steel but that any other metal, ceramic or plastic material may be used.

Figure 3:
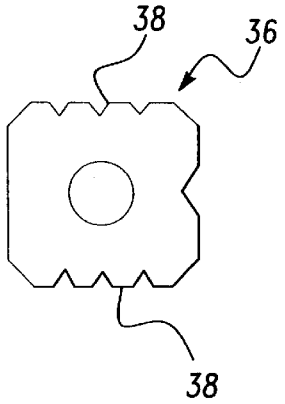
FIG. 3 shows a side view of a jaw member.
Figure 4:
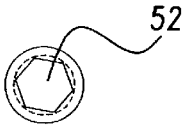
FIG. 4 shows an end view of the turn buckle.
Figure 9:
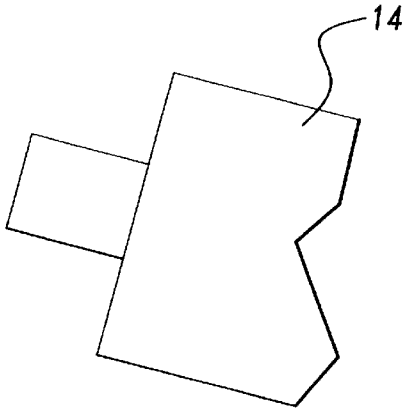
FIG. 9 shows an alternate embodiment of a jaw member.
Figure 9:
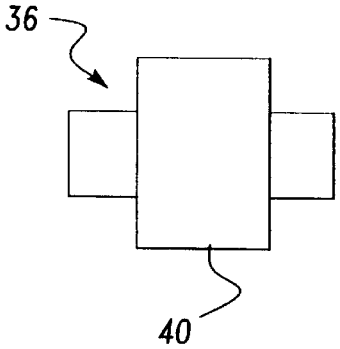
Figure 9A:
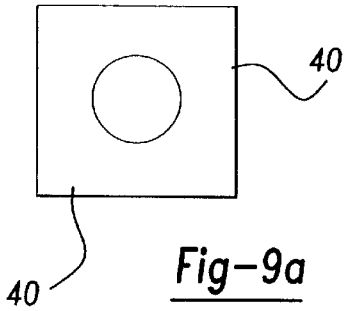
FIG. 9A shows a side view of the jaw member of FIG. 9.
Figure 10:
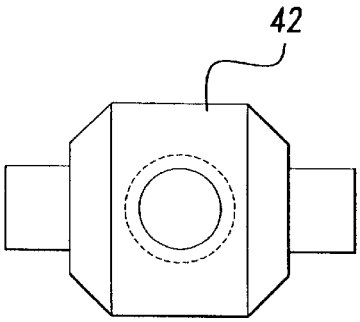
FIG 10 shows a threaded through bolt connector for the present invention.
Figure 10A:
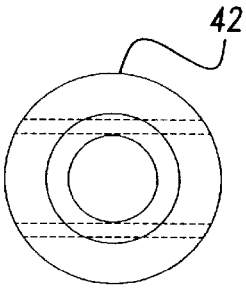
FIG. 10A shows a side view of the threaded through bolt connector of FIG. 10.
Figure 11:
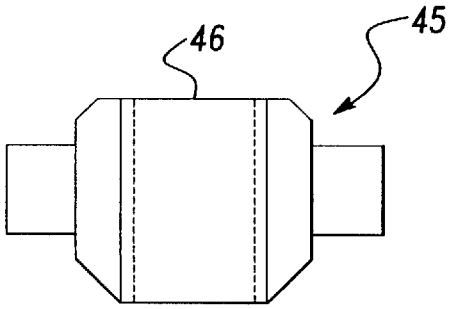
FIG. 11 shows a through bolt connector for the present invention.
Figure 11A:
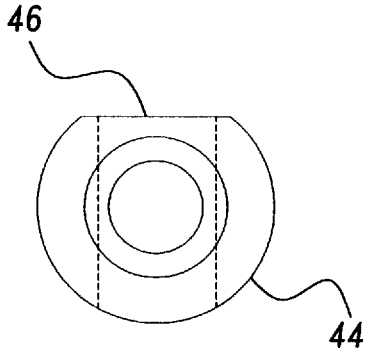
FIG. 11A shows a side view of the through bolt connector of FIG. 11.
Figure 11B:
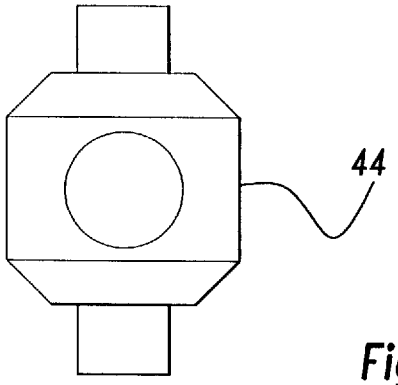
FIG. 11B shows a top view of the through bolt connector of FIG. 11.

A jaw member 36, as shown in FIG. 3 and FIG. 9, is connected on the opposite end of the link members 20, 32 from the common pivot point 34. A first jaw member 36 is connected between the first and second link member 20 while a second jaw member 36 is connected between the third and fourth link member 32. The first and second jaw members 36 are secured via a rivet or other appropriate fastener, between the orifices 22 of the first and second link members 20 and the third and fourth link members 32 respectively. The jaw members 36 will allow the objects being clamped together to be gripped and properly secured between the clamp 12. The jaw members 36 will reduce the amount of slipping and damage to the objects being clamped. FIG. 3 shows a jaw member 36 having a corrugated surface 38. FIG. 9 shows a jaw member 36 having a flat surface 40 for use on wood and the like. FIG. 10 shows a threaded through bolt connector 42 having a circular surface. FIG. 11 shows a through bolt connector 45 having a circular 44 and flat surface 46 combination. The preferred embodiment uses the corrugated surface jaw member but any of the jaw members along with any other possible shapes for the jaw members may be used depending on the environment the clamp is being used in.

Figure 6:
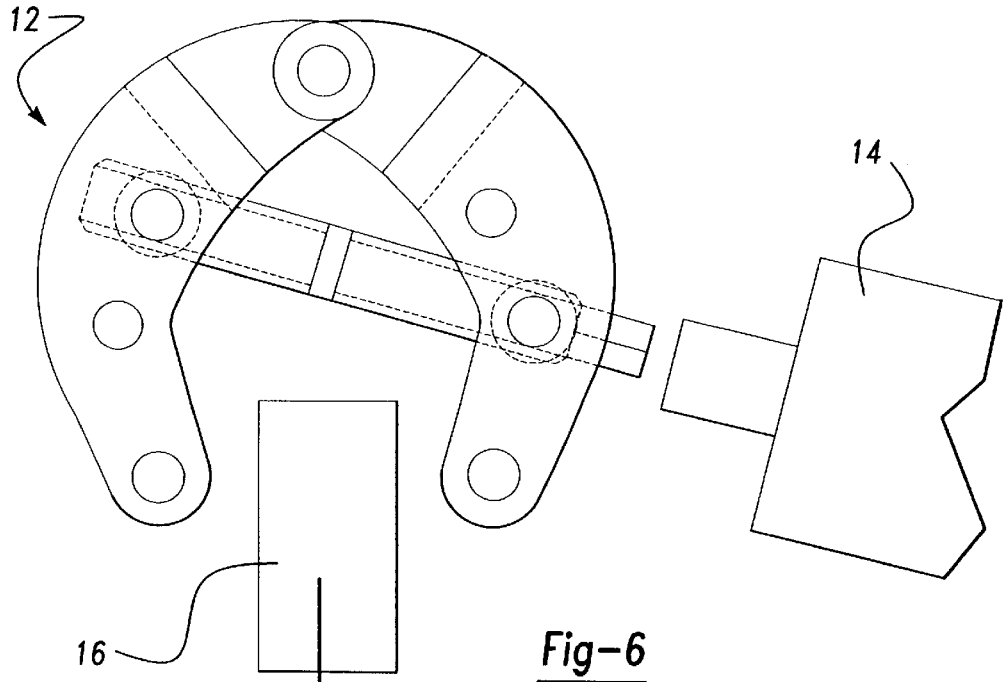
FIG. 6 shows the present invention clamping from an overhead position.
Figure 7:
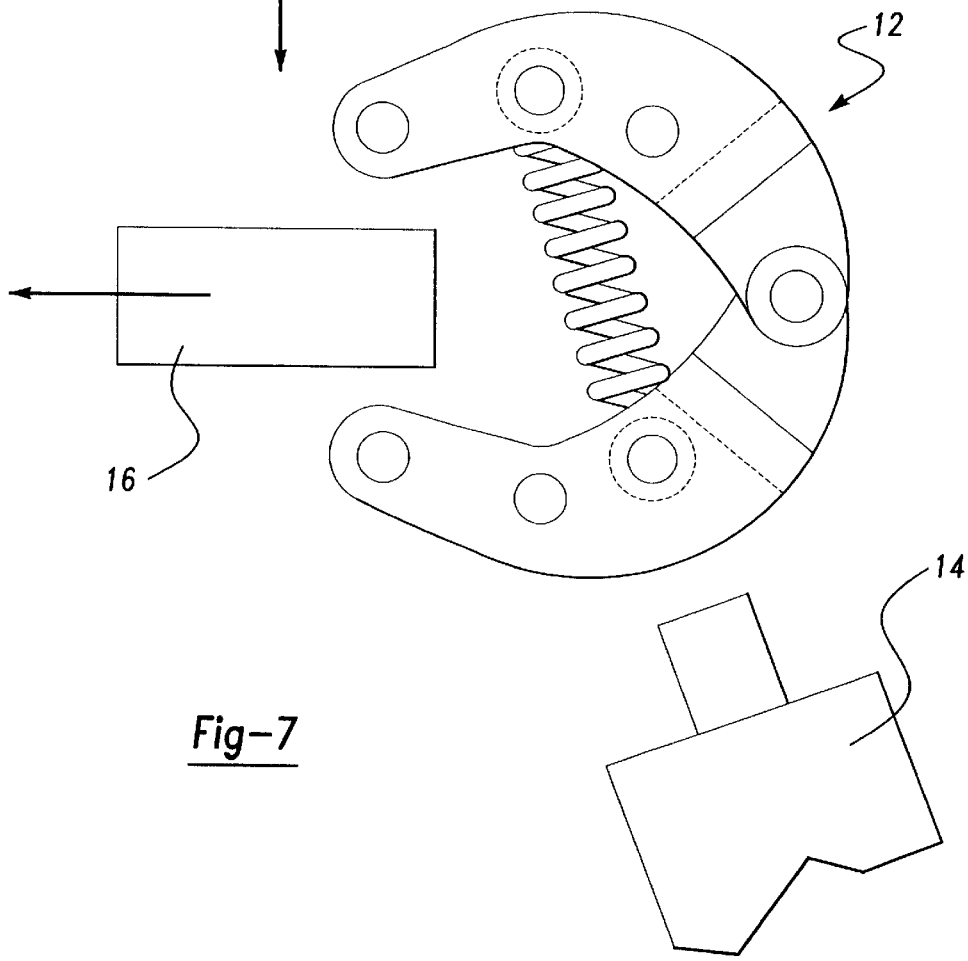
FIG. 7 shows the present invention clamping from a side position.
Figure 8:
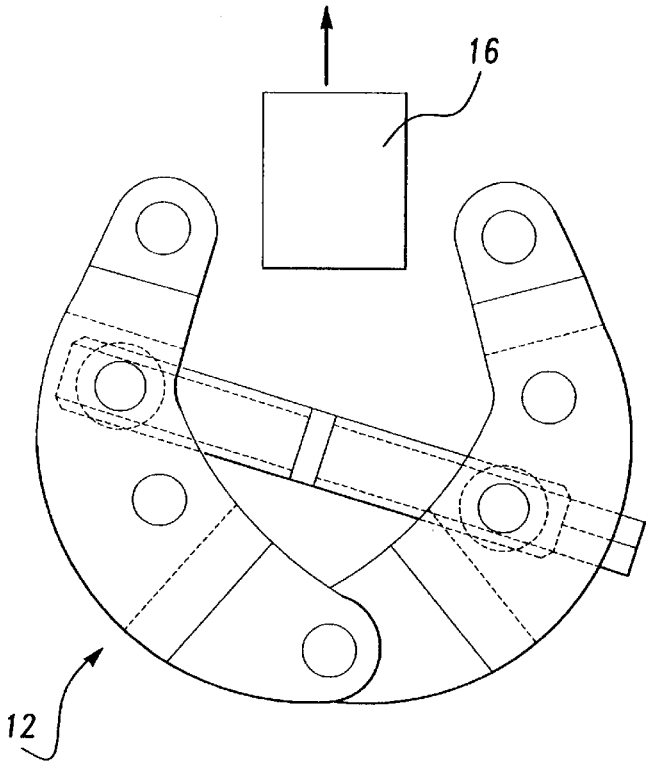
FIG. 8 shows the present invention clamping from an underneath position.

The first pair of link members 20 is connected to the second pair of link members 32 at two other positions depending on the position necessary for the clamp 12 in the work environment. As shown in FIG. 1 a turn buckle 48, which includes a left threaded and a right threaded portion, is connected between an orifice 26 on the first pair of link members 20 and a separate orifice 24 on the third and fourth link members 34. The turn buckle 48 is connected to the link member 20, 32 via two threaded through bolts 42 or any other appropriate securing means available. However, it should be noted that in an alternate embodiment one threaded through bolt connector 42 is used along with one unthreaded through bolt connector 45. This alternate embodiment is used with an allen head cap screw and spring. The turn buckle 48 as shown in FIG. 1 is preferably used to clamp horizontally placed objects as shown in FIG. 7. The orifice 24 on the first set of link members 20 and the orifice 26 on the second set of link members 32 are connected with a rivet or other appropriate securing means to further strength the clamp 12. However, it should be noted the turn buckle 48 may also be placed in the opposite set of orifices on the first set of link members 20 and the second set of link members 32, this will allow for an ergonomically friendly clamp. An example of the turn buckle 48 installed on the clamp 12 for clamping vertical objects can be found in FIG. 6 and 8. The empty orifice between the first and second link member 20 and the empty orifice between the third and fourth link member 32 would once again be connected via a rivet or other appropriate securing means to further strength the clamp 12. Thus, the clamp 12 is adjustable depending on the objects being clamped together and their reference to the user performing the clamping operation. This adjustability allows for a user friendly squeeze clamp that will reduce on the job hazards and injures and sick time due to carpaltunnel syndrome or other ailments of the arm from performing repetitive tasks at awkward angles.

In operation an electrical screw driver 14 or any other manual driving means is placed within a hex end 52 of the turn buckle 48. It should be noted that the turn buckle 48 has a hex end 52 but that any other common head type may be used such as Phillips head, straight head or any other available head for the turn buckle 48. It should be further noted that the present inventions preferred embodiment uses a turn buckle 48 which has left and right threads in order to speed the clamping and unclamping process of the squeeze clamp 12. However, it should be noted that a bolt and spring combination such as an allen head cap screw and spring may also be used along with any other reasonable threaded fastener or any other type of fastener capable of squeezing the links together and unclamping the links. The standard driver 14 is placed within the hex end of the turn buckle 48 and by turning it in the clockwise direction the turn buckle left and right threads pull the pair of link members 20, 32 towards one another until the jaw members 36 come in contact with the objects being clamped. To unclasp the clamp the turn buckle hex head 52 is turned in a counter clockwise direction which will push the sets of link members away from one another such that the object being held is released and the clamp is opened. The squeeze clamp 12 of the present invention does not have handles which allows for the clamp to be used in more confined spaces and allows for better design of the work environment about which the user works. The handleless squeeze clamp 12 also provides for less work related injuries due to carpaltunnel syndrome and other injuries of the wrist and arm due to repetitive motions by using handles and the like.

The present invention has been described in an illustrative manner, it is to understood that the terminology which has been used is intended to be in the nature of words of description rather than of limitation.

Many modifications and variations of the present invention are possible in light of the above teachings. Therefore, within the scope of the appended claims, the present invention may be practiced otherwise then as specifically described.

What is claimed is:

1. A squeeze clamp, said clamp including:

a first link member and a second link member which are identical to one another, said first and second link members having a first off-set and a second off-set;

a third and fourth link member which are identical to one another, said third and fourth link members having a first off-set and a second off-set;

said first, said second, said third, and said fourth link members all connected at a common pivot point;

a turn buckle having left and right threads connected to said first and second link members at one end thereof, said opposite end of said turn buckle connected to said third and fourth link members, said turn buckle mounted in one of a plurality of positions;

a first and second jaw member, said first jaw member connected to an end opposite said common pivot point of said first and second link members, said second jaw member connected to an end opposite of said pivot point of said third and fourth link member.

2. The clamp of claim 1, wherein said link members are made of steel.

3. The clamp of claim 1, wherein said turn buckle includes a thread and spring mechanism.

4. The squeeze clamp of claim 1, wherein said link members include a plurality of orifices.

5. The clamp of claim 1, wherein said pivot point includes a rivet.

6. The clamp of claim 1, wherein said jaw members are connected to said link members with a rivet.

7. The clamp of claim 1, wherein said turn buckle is connected to said link members with a through bolt connector.

8. A squeeze clamp, said clamp including:

a plurality of link members, said link members having a plurality of orifices, said plurality of link members are connected at a common pivot point;

a threaded member connected to at least two of said link members;

a first and a second jaw member connected to said link members;

said threaded member capable of being placed in a plurality of positions within said link members, said link members having a first off-set and a second off-set.

9. The clamp of claim 8, wherein said threaded member is a turn buckle.

10. The clamp of claim 8, wherein said turn buckle includes a left and a right thread.

11. The clamp of claim 8, wherein said threaded member includes a bolt and spring combination.

12. The clamp of claim 11 wherein said bolt and spring includes an allen head cap screw and spring.

13. The clamp of claim 8, further including an electric drive system to turn said threaded member in a clockwise direction to close said clamp and to turn said threaded member in a counter clockwise direction to open said clamp.

14. The clamp of claim 13, wherein said electric drive system is an electrical screw driver.

15. The clamp of claim 8, wherein said jaw members include a corrugated surface on their clamping surfaces.

16. The clamp of claim 8, wherein said clamp is adjustable to provide ergonomic comfort to said user by adjusting an angle of said threaded member in relation to said user's hand.

17. The clamp of claim 8, wherein said adjustment of said threaded member can occur by connecting said threaded member to said plurality of predetermined positions.

18. The clamp of claim 8, wherein said link members are made of steel.

* * * * *